US006642901B2

(12) United States Patent
Matsumoto et al.

(10) Patent No.: US 6,642,901 B2
(45) Date of Patent: Nov. 4, 2003

(54) HORN ANTENNA APPARATUS

(75) Inventors: Soichi Matsumoto, Tokyo (JP); Hiroshi Shigesawa, Shiga (JP); Mikio Tsuji, Kyoto (JP); Hiroyuki Deguchi, Osaka (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/082,114

(22) Filed: Feb. 26, 2002

(65) Prior Publication Data

US 2002/0186174 A1 Dec. 12, 2002

(30) Foreign Application Priority Data

Jun. 7, 2001 (JP) ..... 2001-172557

(51) Int. Cl.[7] ..... H01Q 13/00
(52) U.S. Cl. ..... 343/786; 343/756; 343/772
(58) Field of Search ..... 343/786, 756, 343/772; 333/126

(56) References Cited

U.S. PATENT DOCUMENTS 3,898,669 A * 8/1975 Blume ..... 343/786
6,396,453 B2 * 5/2002 Amyotte et al. ..... 343/786

OTHER PUBLICATIONS

H. Deguchi, et al., "A Compact Low–Cross–Polarization Horn Antenna with Serpentine–Shaped Taper", IEEE AP–S (2001–7).

* cited by examiner

*Primary Examiner*—James Clinger
(74) *Attorney, Agent, or Firm*—Oblon, Spivak, McClelland, Maier & Neustadt, P.C.

(57) ABSTRACT

In a horn antenna apparatus for use in an antenna system for radar, some of the excited radio waves in a TE11 mode in a radio-wave input portion 1 are converted to those in a higher mode in a waveguide portion 5. As the inclination of a line of intersection S of the waveguide portion 5 is not fixed but continuously varied, the higher mode such as a TM11 mode and TE12 mode and the like is excited everywhere in the direction of the axis Z of the waveguide portion 5. Then the configuration of the line of intersection is determined so that an amplitude and a phase as the generated quantity of higher mode such as the TM11 mode generated in the waveguide portion 5 conform to desired values with respect to each higher mode.

4 Claims, 4 Drawing Sheets

TE11 MODE

TM11 MODE

TE11+TM11,etc. MODE

HORN ANTENNA APPARATUS

BACKGROUND OF THE INVENTION

1. Field of the Invention

The present invention relates to a horn antenna apparatus for use in an antenna system for radar, radio communication and so forth and in the primary radiator of such an antenna system and for radiating radio waves into space with desired characteristics.

2. Description of the Related Art

FIG. 6 is a sectional view of a dual-mode type horn antenna apparatus among the conventional horn antenna apparatus shown in, for example, the "Satellite Communication Technology" published by the "Institute of Electronics, Information and Communication Engineers of Japan" on Nov. 10, 1980. In FIG. 6, reference numeral 1 denotes a radio-wave input portion having a circular inner waveguide diameter; 2, an aperture portion of a horn antenna for radiating radio waves into space; and 3, a tapered waveguide portion, the waveguide portion 3 is formed such that its inner diameter is increased from the side of the radio-wave input portion 1 toward the aperture portion 2. Further, reference numeral 4 denotes a higher-mode generating portion having an inner diameter that changes stepwise or in a tapered manner and used for generating higher-mode radio waves of out of the radio waves fed.

The operation of the conventional horn antenna apparatus will now be described. In the radio-wave input portion 1, radio waves having an electric field distribution in a TE11 mode as the basic mode of the circular waveguide are excited. The electric field distribution in the TE11 mode is shown in FIG. 7A. In the higher-mode generating portion 4, some of the radio waves having the electric field distribution in the TE11 mode in the radio-wave input portion 1 are converted into a higher mode such as a TM11 mode. The electric field distribution in the TM11 mode is shown in FIG. 7B. The radio waves in the dominant mode and the higher mode propagate through the waveguide portion 3 and reaches the aperture portion 2. At this time, the inner diameter $\phi D$ and the taper angle $\theta$ of the inner diameter of the higher-mode generating portion 4 are set at proper values so that the amplitude and phase of the higher mode such as the TM11 mode generated in the higher-mode generating portion 4 may satisfy desired values. Thus, the aperture distribution of the radio waves in the aperture portion 2 can be made to conform to an electric field distribution shown in FIG. 7C. In other words, the electric field distribution in the aperture portion shown in FIG. 7C is what is obtained by superposing the electric field distribution in the higher mode such as the TM11 mode on the electric field distribution in the TE11 mode and becomes a rotationally symmetrical electric field distribution without generating cross polarization.

As the conventional horn antenna apparatus is thus arranged, the quantity (amplitude and phase) of the TM11 Mode and the like generated in the higher-mode generating portion 4 can be set at an ideal value at a predetermined frequency of fo. However, a deviation in the quantity of the higher mode thus generated occurs when the frequency deviates from fo and while the radio wave propagating through the tapered waveguide portion 3, the phase quantity in the higher mode also deviates with respect to the dominant mode. As a result, the electric field distribution generated in the aperture portion 2 does not become rotationally symmetrical in case where the frequency is thus deviated and the problem is that the cross polarization is generated therein. In the conventional horn antenna apparatus, moreover, because a plurality of higher modes are not controllable so that an optimum quantity of, for example, the TM11 and TE12 modes is simultaneously generated in the higher-mode generating portion 4, there still exists a problem of making unattainable a horn antenna apparatus which is rotationally symmetrical and generates a smaller quantity of cross polarization over a wide frequency range.

SUMMARY OF THE INVENTION

An object of the present invention made to solve the foregoing problems is to provide a horn antenna apparatus which is rotationally symmetrical and generates a desired quantity of higher mode and a smaller quantity of cross polarization over a wide frequency range.

In order to achieve the above object, there is provided a horn antenna apparatus including: a radio-wave input portion for receiving radio waves; a waveguide portion for propagating the radio waves received; and an aperture portion for radiating the radio waves propagated by said waveguide portion into space; wherein in said waveguide portion, the inclination of a line of intersection crossing a plane including an axis in the direction of propagating radio waves with respect to said axis is not fixed but continuously varied; and wherein a distance between said line of intersection and said axis increases from the side of said radio-wave input portion toward the side of said aperture portion.

In the present invention, the distance between said line of intersection and said axis may decrease, in part of said line of intersection, from the side of said radio-wave input portion toward the side of said aperture portion.

Also, according to the present invention, there is provided a horn antenna apparatus including: a radio-wave input portion for receiving radio waves; a waveguide portion for propagating the radio waves received; and an aperture portion for radiating the radio waves propagated by said waveguide portion into space; wherein in said waveguide portion, the inclination of a line of intersection crossing a plane including an axis in the direction of propagating radio waves with respect to said axis is not fixed but continuously varied in part of said line of intersection; and wherein the distance between said line of intersection and said axis increases from the side of said radio-wave input portion toward the side of said aperture portion.

In the present invention, the distance between said line of intersection and said axis may increase, in part of said line of intersection, from the side of said radio-wave input portion toward the side of said aperture portion.

Further, according to the present invention, there is provided a horn antenna apparatus including: a radio-wave input portion for receiving radio waves; a waveguide portion for propagating the radio waves received; and an aperture portion for radiating the radio waves propagated by said waveguide portion into space; wherein in said waveguide portion, a line of intersection crossing a plane including an axis in the direction of propagating radio waves includes a plurality of straight lines; and wherein the distance between said line of intersection and said axis increases, in part of said line of intersection, from the side of said radio-wave input portion toward said of said aperture portion.

DETAILED DESCRIPTION OF THE PREFERRED EMBODIMENTS

Now, a description of the invention will be given in more detail of preferred embodiments of the invention with reference to the accompanying drawings.

Embodiment 1

Figure 1:
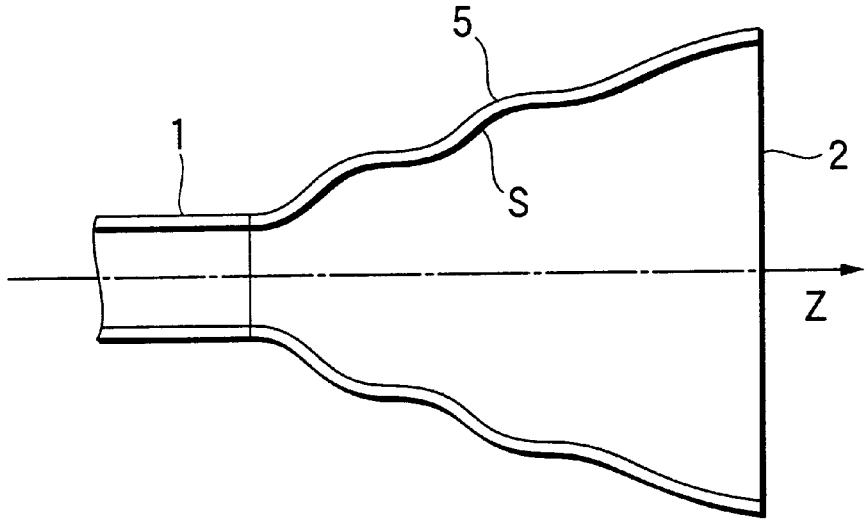
FIG. 1 is a sectional view of a horn antenna apparatus according to Embodiment 1 of the invention.

A horn antenna apparatus according to Embodiment 1 of the present invention will now be described with reference to FIG. 1. FIG. 1 is a sectional view of a horn antenna apparatus according to Embodiment 1 of the invention. In FIG. 1, reference numeral 1 denotes a radio-wave input portion for receiving radio waves, the radio-wave input portion 1 being formed with a circular or rectangular waveguide, a coaxial cable or the like; 2, an aperture portion of a horn antenna for radiating radio waves into space; and 5, a waveguide portion that is circular or elliptic in cross section, the waveguide portion 5 being used for propagating radio waves in the direction of the axis Z (central axis of the waveguide portion 5) shown in FIG. 1. Instead of the conventional tapered waveguide portion, this waveguide portion 5 is formed such that an inclination of a line of intersection (line of intersection S of FIG. 1) crossing a plane including the axis Z with respect to the axis Z is not fixed but continuously varied. Further, this line of intersection S is formed so that the distance between the line of intersection S and the axis Z increases from the side of the radio-wave input portion 1 toward that of the aperture portion 2. In other words, the rate of change of the inner diameter of the waveguide portion 5 in the direction of the axis Z is not fixed but continuously varied and has a positive value. In this case, the line of intersection S is a line segment in which the inner wall of the waveguide portion 5 and the plane including the axis Z cross each other.

Figure 7A:
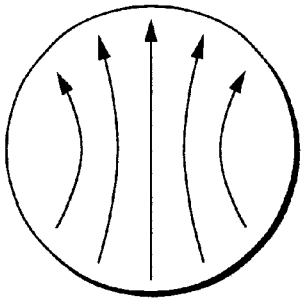
FIGS. 7A to 7C are exemplary diagrams showing an electric field distribution in dominant and higher modes propagating through the horn antenna apparatus.
Figure 7B:
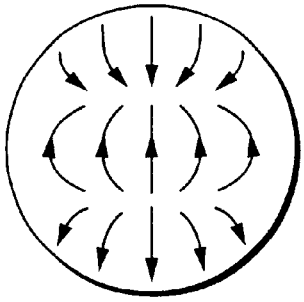
Figure 7C:
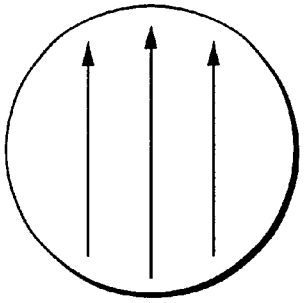

Radio wave propagation in the horn antenna apparatus according to Embodiment 1 of the invention will now be described. Radio waves are fed into the radio-wave input portion 1 by a waveguide, a coaxial cable or the like. In the radio-wave input portion 1, radio waves in a TE11 mode are excited. Some of the excited radio waves in the TE11 mode are converted to those in the higher mode in the waveguide portion 5. As the inclination of the line of intersection S of the waveguide portion 5 is not fixed but continuously varied, the higher mode is excited (converted from the lower mode to the higher mode) everywhere in the direction of the axis Z of the waveguide portion 5. Thus, the higher mode such as a TM11 mode and the TE12 mode are successively generated in the direction of the axis Z and reaches the aperture portion 2. It is thus possible to obtain such a horn antenna apparatus that the electric field distribution in the aperture portion 2 is rotationally symmetrical with the generation of a cross polarization component being kept under control over a wide frequency range as shown FIG. 7C by determining the shape of the line of intersection S so that an amplitude and a phase as the generated quantity of higher mode such as the TM11 mode generated in the waveguide portion 5 conform to desired values with respect to each higher mode.

Embodiment 2

Figure 2:
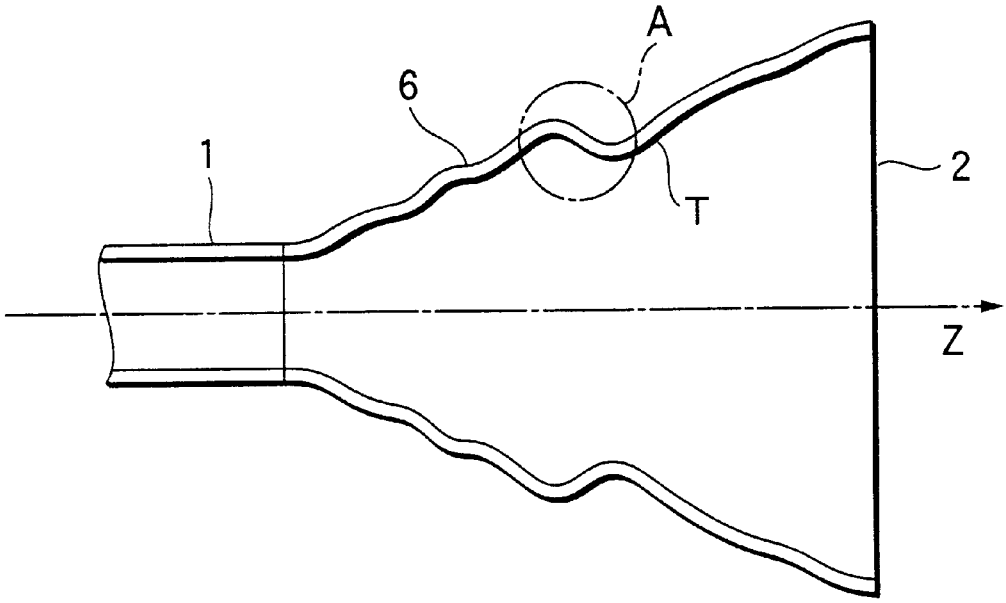
FIG. 2 is a sectional view of a horn antenna apparatus according to Embodiment 2 of the invention.

A horn antenna apparatus according to Embodiment 2 of the invention will now be described with reference to FIG. 2. FIG. 2 is a sectional view of a horn antenna apparatus according to Embodiment 2 of the invention. In FIG. 2, reference numeral 6 denotes a waveguide portion that is circular or elliptic in cross section, the waveguide portion 6 being used for propagating radio waves in the direction of the axis Z (central axis of the waveguide portion 6) shown in FIG. 2. Instead of the conventional tapered waveguide portion, this waveguide portion 6 is formed such that an inclination of a line of intersection (line of intersection T of FIG. 2) crossing a plane including the axis Z with respect to the axis Z is not fixed but continuously varied. Further, this line of intersection T is formed so that the distance between the line of intersection T and the axis Z decreases, in part of the line of intersection T, from the side of the radio-wave input portion 1 toward that of the aperture portion 2. In FIG. 2, the distance between the line of intersection T and the axis Z decreases in a place A from the side of the radio-wave input portion 1 toward that of the aperture portion 2. In other words, the rate of change of the inner diameter of the waveguide portion 5 in the direction of the axis Z is not fixed but continuously varied and even has a negative value. Moreover, the waveguide portion 6 has a throttled shape in the place A of FIG. 2. In this case, the line of intersection T is a line segment in which the inner wall of the waveguide portion 6 and the plane including the axis Z cross each other. In FIG. 2, any portions having like reference numerals in FIG. 1 designate like or corresponding portions in FIG. 1.

Radio wave propagation in the horn antenna apparatus according to Embodiment 2 of the invention will now be described. Radio waves are fed into the radio-wave input portion 1 by a waveguide, a coaxial cable or the like. In the radio-wave input portion 1, radio waves in the TE11 mode are excited. Some of the excited radio waves in the TE11 mode are converted to those in the higher mode in the waveguide portion 6. As the inclination of the line of intersection T of the waveguide portion 6 is not fixed but continuously varied, the higher mode is excited (converted from the lower mode to the higher mode) everywhere in the direction of the axis Z of the waveguide portion 6. Thus, the higher mode such as the TM11 mode and the TE12 mode are successively generated in the direction of the axis Z and reaches the aperture portion 2. It is thus possible to obtain such a horn antenna apparatus that the electric field distribution in the aperture portion 2 is rotationally symmetrical with the generation of across polarization component being kept under control over a wide frequency range as shown FIG. 7C by determining the shape of the line of intersection T so that an amplitude and a phase as the generated quantity of higher mode such as the TM11 mode generated in the waveguide portion 6 conform to desired values.

As the horn antenna apparatus according to Embodiment 2 of the invention has the throttled shaped as described above whereby to obtain a reverse wavefront effect, the whole length of the horn antenna apparatus can be shortened and the electric field distribution in the aperture portion 2 is made rotationally symmetrical with the generation of a cross polarization component being kept under control over a wide frequency range. Further, by providing a plurality of throttled shapes respectively in a plurality of places of the waveguide portion 6, the electric field distribution in the aperture portion 2 is made rotationally symmetrical with the generation of the cross polarization being kept under control in a plurality of frequency bands.

Figure 3:
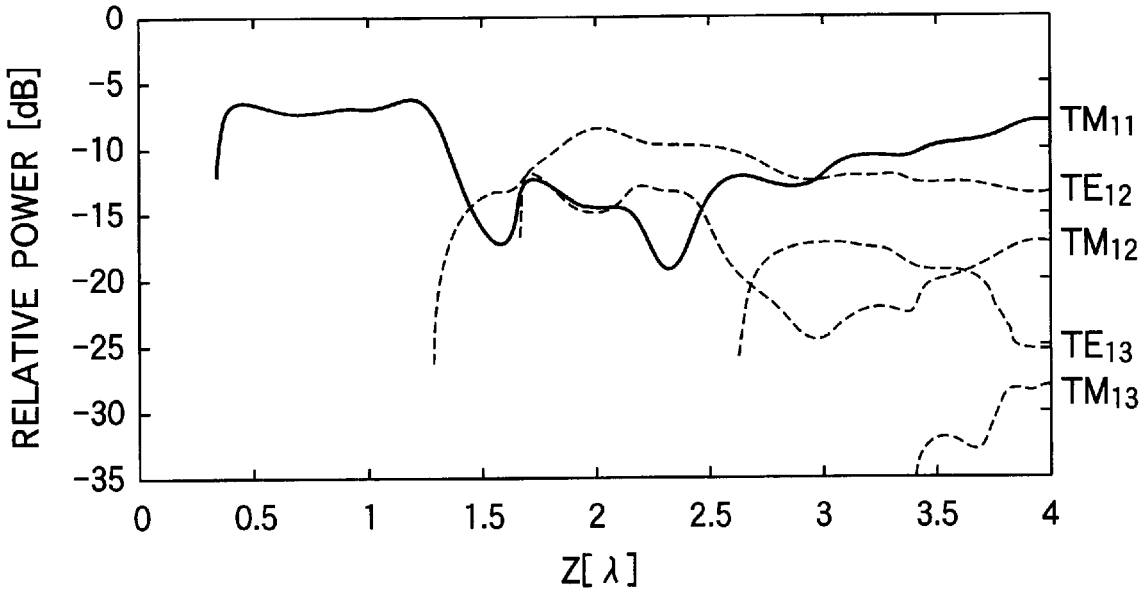
FIG. 3 is a graph showing an example of power generation in the higher mode in each position from the radio-wave input portion 1 over the aperture portion 2 in the horn antenna apparatus having the waveguide portion formed as in Embodiment 1 or 2.

FIG. 3 is a graph showing an example of power generation in the higher mode in each position from the radio-wave input portion 1 over the aperture portion 2 in the horn antenna apparatus having the waveguide portion formed as in Embodiment 1 or 2. The horizontal axis of FIG. 3 refers to the distance in the direction of the axis Z where Z=0 corresponds to the radio-wave input portion 1 and Z=4 to the aperture portion 2. Moreover, the vertical axis refers to the power level generated. As shown in FIG. 3, there are generated higher modes (TM11, TE12, TM12, TE13, TM13) at the respective positions on the axis Z and the generated quantity of each of the higher modes depends on the line of intersection S (or the line of intersection T), so that the desired generated quantity is obtainable in the aperture portion 2.

In case where a waveguide portion is tapered as in the conventional horn antenna apparatus, the relation between the tilted angle of the tapered portion (generally called the flare angle of a horn) and the length of the waveguide portion is such that the smaller the tapered tilted angle, the longer the length of the waveguide portion in order to obtain an electric field distribution with a smaller cross polarization component in the aperture portion. In the horn antenna apparatus so arranged as in Embodiments 1 and 2, that relation is not established, whereby a horn antenna apparatus having the electric field distribution with the smaller cross polarization in the aperture portion is obtainable with a relatively less longer waveguide portion.

Embodiment 3

Figure 4A:
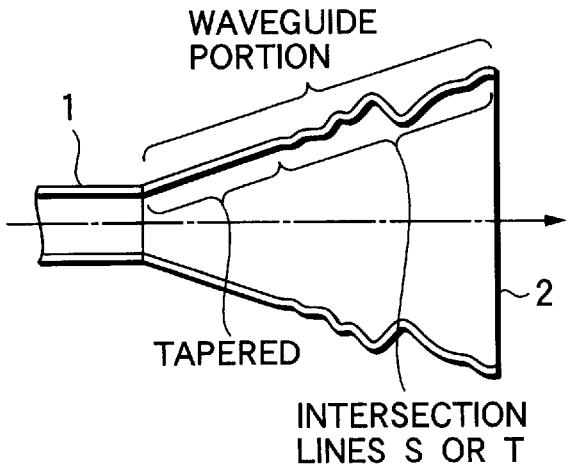
FIGS. 4A and 4B are sectional views of a horn antenna apparatus according to Embodiment 3 of the invention.
Figure 4B:
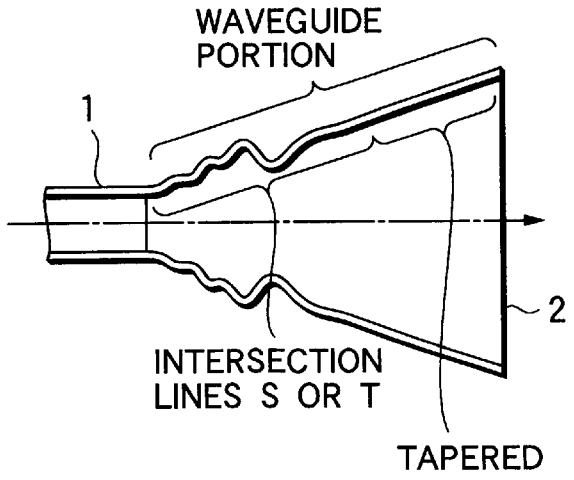

Although the inclinations of the line of intersections S and line of intersection T are not fixed but continuously varied over the whole length of the waveguide portions 5 and 6 as shown in FIGS. 1 and 2 in Embodiments 1 and 2, a waveguide portion may be formed with a tapered portion having the line of intersection S or the line of intersection T and a straight line as shown in FIG. 4A or 4B; that is, the line of intersection S or T may be provided in part of the waveguide portion. FIGS. 4A and 4B are sectional views of horn antenna apparatus according to Embodiment 3 of the invention: in FIG. 4A, a waveguide portion 8 has a tapered portion on the side of the radio-wave input portion 1; and in FIG. 4B, the waveguide portion 8 has a tapered portion on the side of the aperture portion 2. As the waveguide portion 8 has the line of intersection S or T as described in Embodiment 1 or 2 of the invention, Embodiment 3 of the invention has an effect similar to those described in Embodiments 1 and 2 thereof.

Embodiment 4

Figure 5:
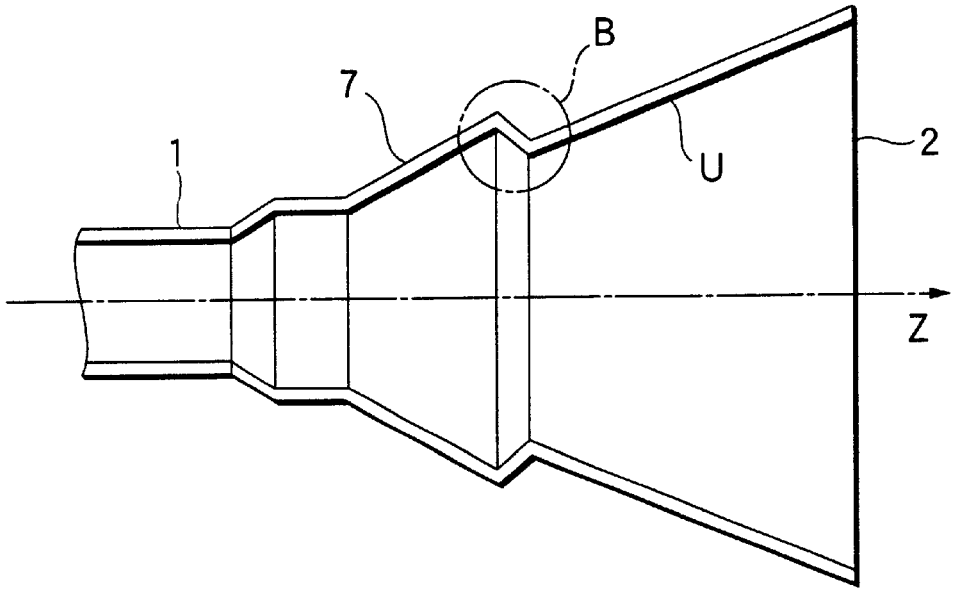
FIG. 5 is a sectional view of a horn antenna apparatus according to Embodiment 4 of the invention.
Figure 6:
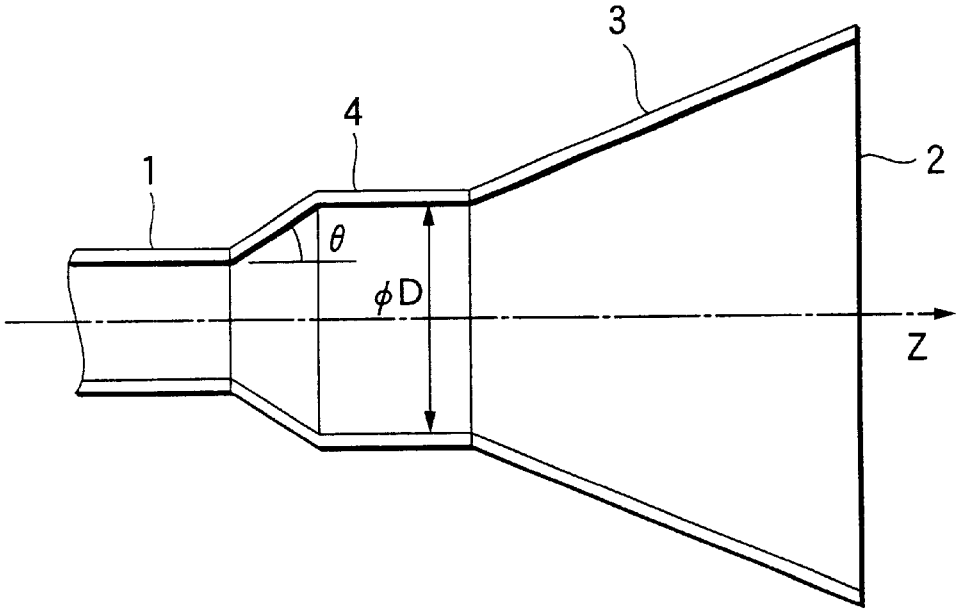
FIG. 6 is a sectional view of a conventional horn antenna apparatus.

An horn antenna apparatus according to Embodiment 4 of the invention will now be described with reference to FIG. 5. FIG. 5 is a sectional view of a horn antenna apparatus according to Embodiment 4 of the invention. In FIG. 5, reference numeral 7 denotes a waveguide portion that is circular or elliptic in cross section, the waveguide portion 7 being used for propagating radio waves in the direction of the axis Z (central axis of the waveguide portion 7) shown in FIG. 5. This waveguide portion 7 is formed such that a line of intersection (line of intersection U of FIG. 5) crossing a plane including the axis Z is formed with a plurality of straight lines. Further, the line of intersection U is formed so that the distance between the line of intersection U and the axis Z decreases, in part of the line of intersection U, from the side of the radio-wave input portion 1 toward that of the aperture portion 2. In FIG. 5, the distance between the line of intersection U and the axis Z decreases in a place B from the side of the radio-wave input portion 1 toward that of the aperture portion 2. In other words, the waveguide portion 7 has a throttled shape in the place B of FIG. 5. In this case, the line of intersection U is a line segment in which the inner wall of the waveguide portion 7 and the plane including the axis Z cross each other. In FIG. 5, any portions having like reference numerals in FIG. 1 designate like or corresponding portions in FIG. 1.

As the horn antenna apparatus according to Embodiment 4 of the invention has the throttled shaped as described above whereby to obtain a reverse wavefront effect, the whole length of the horn antenna apparatus can be shortened and the electric field distribution in the aperture portion 2 is made rotationally symmetrical with the generation of the cross polarization being kept under control over a wide frequency range as described in Embodiment 2.

According to the invention, in the waveguide portion, as the inclination of the line of intersection crossing the plane including the axis in the direction of propagating radio waves is not fixed but continuously varied, the higher mode is excited, whereby it is possible to obtain the horn antenna apparatus having the electric field distribution that is rotationally symmetrical with the smaller cross polarization component over a wide frequency range in its aperture portion.

Also, according to the invention, the reverse wavefront is generated as the waveguide portion has the throttled shape and the whole length of the horn antenna apparatus can be shortened, whereby it is possible to obtain the horn antenna apparatus having the electric field distribution that is rotationally symmetrical with the smaller cross polarization component over a wide frequency range in its aperture portion.

What is claimed is:

1. A horn antenna apparatus comprising:

a radio-wave input configured to receive radio waves;

an aperiodically undulating tapered waveguide configured to propagate the radio waves received; and an aperture configured to radiate the radio waves propagated by said waveguide portion into space.

2. The horn antenna apparatus as claimed in claim 1, wherein the aperiodically undulating tapered waveguide comprises:

a necked waveguide region.

3. A horn antenna apparatus comprising:

a radio-wave input configured to receive radio waves;

a waveguide configured to propagate the radio waves received, said waveguide comprising an aperiodically undulating tapered waveguide connected to a non-undulating tapered waveguide; and an aperture configured to radiate the radio waves propagated by said waveguide portion into space.

4. A horn antenna apparatus comprising:

a radio-wave input configured to receive radio waves;

a waveguide configured to propagate the radio waves received, said waveguide comprising a first tapered waveguide directly connected to a second tapered waveguide by a third tapered waveguide, said first and second tapered waveguides having a positive slope and said third tapered waveguide having a negative slope; and an aperture configured to radiate the radio waves propagated by said waveguide portion into space.

* * * * *